United States Patent [19]

Garcea

[11] 4,128,086

[45] Dec. 5, 1978

[54] AUTOMATIC DEVICE FOR CONTROLLING THE PRESSURE OF THE INTAKE AIR OF AN I.C. ENGINE AS ITS OPERATING ALTITUDE VARIES

[75] Inventor: Giampaolo Garcea, Milan, Italy

[73] Assignee: Alfa Romeo S.p.A., Milan, Italy

[21] Appl. No.: 767,446

[22] Filed: Feb. 10, 1977

[30] Foreign Application Priority Data

Feb. 10, 1976 [IT] Italy ..... 20045 A/76

[51] Int. Cl.[2] ..... F02B 75/02; F02M 1/10

[52] U.S. Cl. ..... 123/75 D; 123/97 B; 123/103 B; 123/119 F; 261/39 A; 261/64 B

[58] Field of Search ..... 123/75 D, 97 B, 103 R, 123/103 B, 119 F; 261/DIG. 19, 39 A, 73, 72 A, 64 B, 64 C

[56] References Cited

U.S. PATENT DOCUMENTS

| | | | |
|---|---|---|---|
| 1,675,678 | 7/1928 | Weismann | 123/75 D |
| 2,481,259 | 9/1949 | Taylor | 261/64 C |
| 2,505,292 | 4/1950 | Mallory | 123/103 R |
| 2,588,136 | 3/1952 | Mallory | 123/103 R |
| 2,668,697 | 2/1954 | Sager | 261/39 A |
| 2,749,938 | 6/1956 | Thomas | 123/103 R |
| 2,970,586 | 2/1961 | Cramer | 123/103 R |
| 3,836,128 | 9/1974 | Lunsford | 261/39 A |
| 3,984,503 | 10/1976 | Gistucci | 261/39 A |

FOREIGN PATENT DOCUMENTS

| | | | |
|---|---|---|---|
| 2435258 | 2/1975 | Fed. Rep. of Germany | 261/39 A |
| 566357 | 2/1924 | France | 123/75 D |

*Primary Examiner*—Charles J. Myhre
*Assistant Examiner*—Craig R. Feinberg
*Attorney, Agent, or Firm*—Diller, Ramik & Wight

[57] ABSTRACT

This invention relates to an automatic device for controlling the pressure of the intake air of an internal combustion engine as its operating altitude varies. The device according to the invention comprises first valve means adapted to keep the air pressure downstream of the said valve means substantially constant and equal to the external pressure corresponding to a predetermined altitude, first actuator means which control said first valve means as a function of an operating pressure which varies with the altitude and reaches at said predetermined altitude a value equal to the substantially constant value downstream of the first valve means, and second valve means controlled by second actuator means sensitive to an absolute pressure which is a function of the external atmospheric pressure, said second valve means being able to modulate said operating pressure.

8 Claims, 4 Drawing Figures

Figure 1:
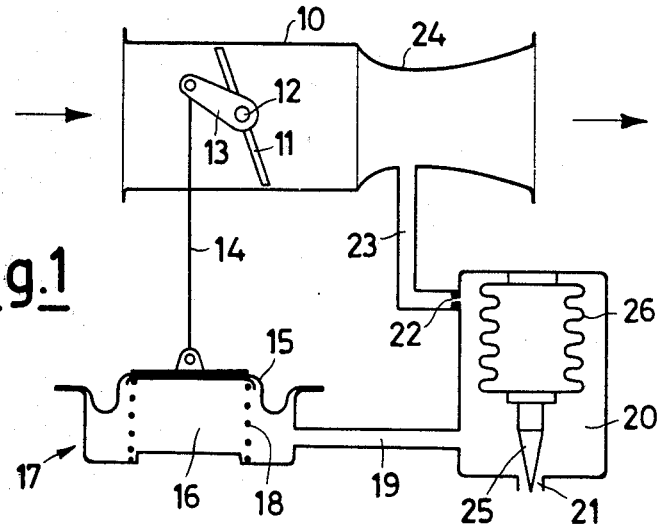

AUTOMATIC DEVICE FOR CONTROLLING THE PRESSURE OF THE INTAKE AIR OF AN I.C. ENGINE AS ITS OPERATING ALTITUDE VARIES

As the operating altitude of a motor vehicle provided with an internal combustion engine supplied by a carburetor changes, the air-gasoline ratio of the mixture which the carburetor feeds to the engine also generally changes due to the variation in air density. As this leads to an increase in the mixture richness with altitude, harmful emissions at the engine exhaust and fuel consumption consequently increase. Compared with devices already constructed for preventing this carburetor defect (but not widespread at the moment) the device according to the present invention is characterised in that as the density of the external air varies (with altitude) it is able to keep the density of the air reaching the carburetor constant. It is thus able to prevent the air-gasoline ratio of the mixture fed to the I.C. engine by the carburetor altering with increasing operating altitude, relative to its setting at zero altitude.

In order to clarify this characteristic of the present invention and the concepts on which it is based, it should be noted that the A/F mixture ratio for an engine supplied by a single or double carburetor is defined as the ratio of the rate of air intake by the motor in terms of weight, to the rate of gasoline delivery into the carburettor by weight, this gasoline then also being drawn in by the engine.

The gasoline is delivered through the set jets (idling, acceleration and main), and this delivery is also defined in terms of flow rate, by the fall in pressure which the air drawn in undergoes (in relation to its flow) as it traverses the carburetor (both in the throttle zone and in the venturi zone). In consequence (as is known) at each of the points in the range of use of the engine, defined by a rotational speed $n$ and a throttle angle $\alpha$ there is a mixture ratio $$(A/F)_{n;\alpha} = K_{n;\alpha} \cdot \sqrt{\delta A/\delta B} \quad (1)$$

where $K_{n;\alpha}$ is a constant which depends on the design of the carburetor. For a traditional carburetor comprising a main system and an idling-acceleration system, the constant $K_{n;\alpha}$ depends on the ratio between the areas of the ports traversed by the air (venturi; air jets at the emulsion chambers), traversed by the pre-mixture (outlet jets from the emulsion chambers), and traversed by the gasoline (gasoline inlet jets in the emulsion chambers), but it also depends on the particular pair of values of n and $\alpha$ which characterize the particular region of the range of use of the engine. In the various regions over the range of use, the utilization of the components of the carburetor (idling, acceleration, main system) is different. If $\delta A$ is the air density at the carburetor inlet and $\delta B$ is the gasoline density, equation (1) shows that a variation in air density influences the mixture ratio. As the air density $\delta A$ is proportional to the ratio P/T of its pressure to its absolute temperature, (1) may be rewritten:

$$(A/F)_{n;\alpha} = K_{n;\alpha} \cdot \sqrt{(P/T)} \cdot \sqrt{1/\delta B} \quad (2)$$

With carburetors set for operation at zero altitude (approximately sea level) and average temperature (approximately 15°-20° C.) only a temperature lower or much lower than the set temperature causes impoverishment of the mixture to such an extent as to compromise regular ignition and combustion. A higher temperature or a higher altitude of operation (lower atmospheric pressure and air density) lead to enrichment which generally does not compromise regular engine operation.

Thus while the emission of polluting substances at the exhaust and the fuel consumption was of no great importance, manufacturers occupied themselves mainly with solving the problem of low temperature carburetion by means of manual enrichment devices and devices for pre-heating the air drawn in by the engine. For the same reason, more recently automatic devices have become available for the temperature control of the air drawn in. As engines operate with very poor mixtures in order to contain the emission of polluting substances at the exhaust, even not very low ambient temperatures compromise their regular operation.

The mixture enrichment which occurs during operation at high altitude or high ambient temperature is no longer acceptable now that it is necessary to contain the polluting substances in the exhaust gas and reduce fuel consumption. However, known devices for solving these problems in the case of engines fed by carburetors are not satisfactory from all points of view. This derives from the great complexity of the problem of correcting carburetion at the various atmospheric pressures (corresponding to the various altitudes) in the sense of annulling the variations in mixture ratio due to the variation in altitude. This complexity emerges from the two following considerations:

(a) According to the actual region in the range of use of the engine, i.e. according to the pair of values (n; $\alpha$), the mixture may be formed either by the idling and acceleration system alone, or by the main system along, or partly by the one and partly by the other. Thus the value of the constant $K_{n;\alpha}$ relative to the particular point (n;$\alpha$) derives from the configuration of said systems.

(b) The corresponding region in which it is most important to introduce the correction is the region of maximum use, which is that served by the idling and acceleration system. In said system the negative pressure in the emulsion chamber (which causes gasoline delivery) depends on the ratio of the area of the air inlet ports to the area of the mixture outlet ports.

As is known, this ratio changes strongly according to the throttle angle $\alpha$, because according to the position of the throttle edge the acceleration holes, which for $\alpha = 0°$ are air inlet ports, progressively become mixture outlet ports as $\alpha$ increases. It is therefore not possible for a single intervention in the sense of modifying, for a given atmospheric pressure, the air flow entering the emulsion chamber to have the same effect for all values of $\alpha$.

In the past, the only solutions adopted were those in which the gasoline inlet port in the emulsion chamber of the idling and acceleration system was varied by a shaped pin moved by a barometric capsule for each altitude. These solutions are hardly satisfactory because of the difficulty of metering variations of a passage section which is very small. Even though in the meantime design and technological improvements have occurred, the solution is always penalized by poor accuracy and does not appear adequate for the requirements of eliminating the emission of polluting substances.

It is evident that if it is required to extend the correction to those states of use in which the main system (greater throttle opening) intervenes, a second barometric capsule must be adopted for this system. In this case the capsule may vary the aperture of the gasoline jet by means of a shaped pin (as for the idling-acceleration system). But it could also vary the inlet air port to the emulsion chamber (i.e. the "air brake" port), as the main system has only one air inlet port and only one pre-mixture outlet port from the emulsion chamber.

A solution of this kind is therefore hardly valid in the case of a single carburetor feeding the entire engine. However, where the engine is fed by a multiple carburetor, or with a single carburetor for each cylinder, the solution appears to be impossible to attain because of the number of capsules and shaped pins required.

One solution which appears satisfactory from many points of view, including reliability and constructional simplicity, is that according to the present invention, based on the concept of making the carburetor insensitive to altitude variations during operation, by annulling the influence which the pressure and density variations in the external air have on the mixture ratio, by controlling the pressure of the air reaching the carburetor.

In order to simplify the construction of the device, it has obviously been appropriate to carry out the pressure control at the lowest working pressure, i.e. at the pressure corresponding to the maximum altitude of normal vehicle operation. In this respect, it is easy to reduce the pressure of the external air, whereas the devices necessary to increase it are too complicated.

The device according to the invention comprises first valve means adapted to induce in the air flow reaching the engine carburetion means a fall in pressure variable between a maximum value at zero altitude and a minimum value at a predetermined altitude; said fall in pressure is such as to keep the pressure downstream of said valve means substantially constant and equal to the external pressure corresponding to said predetermined altitude independently of the altitude of operation of the engine; the device also comprises first actuator means which control said first valve means and are operated by an operating pressure which, as the altitude of operation of the engine increases, assumes intermediate values between the external atmospheric pressure and the pressure existing downstream of said first valve means; at the said predetermined altitude the operating pressure assumes a value equal to the substantially constant value existing downstream of said first valve means. The device also comprises second valve means controlled by second actuator means sensitive to an absolute pressure which is a function of the external atmospheric pressure; the purpose of said second valve means controlled by said second actuator means is to modulate the operating pressure reaching said first actuator means.

In a preferred embodiment, said first valve means are arranged in a duct traversed by the air drawn in by the engine and disposed entirely upstream of said carburetion means; and the said first actuator means consist of a mobile part kinematically linked to said first valve means; said mobile wall defines a cavity which is connected via a fixed calibrated port to that region of said duct located downstream of the first valve means, and is also connected to the external atmosphere via at least one variable port, the cross-section of which is defined by said second valve means; the external atmospheric pressure acts on one of the faces of said mobile wall, and on the other face there acts said operating pressure which is intermediate between the external atmospheric pressure and the pressure downstream of said first valve means; said pressure assumes a maximum value at zero altitude and a minimum value, equal as stated to the substantially constant value downstream of said first valve means, at the said predetermined altitude; elastic means are engaged with the mobile wall to exert a reaction which balances the force acting on the said mobile wall by the effect of the pressure difference across its two faces; the action of these elastic means is such as to reduce the air passage port determined by the first valve means in said duct, while the action of the pressure difference is such as to increase said port.

The said second actuator means consist of an element deformable in accordance with the absolute pressure to which it is subjected; the deformable element may be subjected in one version of the device to the pressure in said capacity defined by the mobile wall, or in another possible version of the device to the pressure downstream of said first valve means.

Characteristics and advantages of the invention will be more evident on examining the drawings of some embodiments of the device, shown by way of non-limiting example in the drawings of which FIG. 1 is a schematic sectional view showing a preferred embodiment of the invention.

FIGS. 2–5 are schematic sectional views similar to FIG. 1 and show the other modifications of the invention.

In FIG. 1, a duct traversed by the air drawn in by an explosion engine is indicated by the reference numeral 10. The duct may be arranged downstream of the normal intake filter or even upstream of the said intake filter, but must be arranged entirely upstream of the carburetor or carburetors. In the duct 10 there is connected a throttle valve 11, the stem 12 of which, its axis passing through the center of the valve disc, is kinematically connected to the diaphragm 15 by the lever 13 and rod 14. The diaphragm 15 constitutes the mobile wall of a capsule indicated overall by 17. In the cavity 16 of the capsule there is disposed a spring 18 which acts on the diaphragm 15 with a force which balances the force due to the pressure difference across its faces. The cavity 16 is freely connected to the cavity 20 through the duct 19, and the cavity 20 is connected to the outside atmosphere through the port 21 and to that region of the duct 10 downstream of the throttle 11 by the port 22 and duct 23. A venturi 24 is connected in the duct 10 downstream of the throttle 11, and the duct 23 opens into the narrow section of the venturi. The presence of this venturi is not essential for the operation of the device, but prevents the small power loss on full acceleration. The cross-section through the port 21 is variable in relation to the position which the needle valve 25 assumes in relation to this port, while the cross-section of the port 22 is fixed. A barometric capsule to which the needle valve 25 is constrained, is indicated by 26. The said second actuator means therefore consist of this barometric capsule, which is inserted in the cavity 20 and expands by elongation when the pressure in the cavity 20 reduces. The device is able to maintain the pressure of the air traversing the duct 10 at a substantially constant value, independently of changes in the operating altitude of the engine and in the consequent atmospheric pressure variations. As the air density at the outlet of the duct 10 remains substantially constant, the air/gasoline ratio of the mixture formed in the carburetor or carburetors fed by the duct 10 does not alter due to changing altitude.

The air pressure at the outlet of the duct 10 is substantially equal to the atmospheric pressure at the predetermined altitude.

The throttle 11 is controlled by the diaphragm 15 so that it opens to uncover passage sections in the duct 10 which increase as the altitude increases, so that as atmospheric pressure reduces there occurs in the air flow the necessary fall in pressure (decreasing with atmospheric pressure) to reduce the pressure to the predetermined constant value. The diaphragm 15 is subjected to the reaction of the spring 18, which is substantially constant as the spring is very flexible, and to the force due to the pressure difference across its faces. Atmospheric pressure acts on the external face of the diaphragm, while on the internal face there acts a pressure intermediate between atmospheric pressure and the pressure in the duct 10 downstream of the throttle 11, this value depending on the ratio between the cross-sections of the ports 21 and 22.

The relationship between the fall in pressure $\Delta p$ which the intake air undergoes due to the throttle 11, and the pressure difference $\Delta p'$ acting across the diaphragm 15 may be deduced from the fact that the flow $q$ of air passing through the port A (indicated by 21 in FIG. 1) also passes through the port B (indicated by 22) by the effect of $\Delta p$. Thus the sum of the two pressure drops $\Delta p_A$ and $\Delta p_B$ (in A and in B) is equal to $\Delta p$.

$$\Delta p = \Delta p_A = \Delta p_B \quad (1)$$

If $\gamma$ is the specific gravity of the air (considered as a first approximation constant for simplicity), $g$ is the acceleration due to gravity and $W_a$ and $W_B$ are the air speeds in A and B, then:

$$\Delta p_A = \gamma(W_A^2/2g);\ \Delta p_B = \gamma W_B^2/2g \quad (2)$$

$$q = W_A \cdot A = W_B \cdot B$$

$$W_A = q/A;\ W_B = q/B$$

Substituting these values for $W_a$ and $W_B$, (1) becomes:

$$\Delta p = \frac{\gamma}{2g}\ \frac{q^2}{A^2} + \frac{\gamma}{2g}\ \frac{q^2}{B^2} = \frac{\gamma}{2g}\ \frac{q^2}{A^2}\left[1 + \left(\frac{A}{B}\right)^2\right] \quad 3)$$

On the other hand:

$$\Delta p' = \gamma\frac{W_A^2}{2g} = \frac{\gamma}{2g}\cdot\frac{q^2}{A^2} \quad 4)$$

From (3) and (4):

$$\Delta p = \Delta p'\,[1 + (A/B)^2] \quad (5)$$

This relationship allows the manner in which the device is dimensioned and operates to be clarified. It will be assumed that the prechosen altitude is that for which atmospheric pressure is less than the pressure at sea level (1 kg/cm$^2$) by 0.25 kg/cm$^2$, i.e. $\Delta p^* = 0.25$. With the vehicle at sea level, the pressure drop through the throttle 11 must therefore be $\Delta p = 0.25$ kg/cm$^2$ with the engine operating. With the engine at rest, or at the moment of starting, the barometric capsule 26 is shortened by its maximum amount, the needle is completely retracted and the port A has its maximum value $A_{max}$. With the engine at rest or at the moment of starting, $\Delta p'$ is still zero. Because of the force M of the spring, the throttle 11 is in its maximum closure position. With the engine running, and the throttle 11 still closed, the pressure drop $\Delta p$ immediately increases. If $\Delta p$ is not to exceed the value $\Delta p^* = 0.25$ kg/cm$^2$, the pressure difference $\Delta p'$ given by 5) when $\Delta p$ assumes the value $\Delta p^*$ must be greater than the load of the spring M. If M is this load, and S is the surface area of the diaphragm, then:

$$\Delta p' = \frac{\Delta p^*}{1 + \left(\frac{A_{max}}{B}\right)^2} > \frac{M}{S} \quad 6)$$

Thus if M/S = 0.025 kg/cm$^2$, then as $\Delta p^* = 0.25$ kg/cm$^2$:

$$1 + \left(\frac{A_{max}}{B}\right)^2 < \frac{0.25}{0.025} \quad 7)$$

from which $$\frac{A_{max}}{B} < \sqrt{10 - 1} = 3 \quad 8)$$

Thus if B = 3 mm$^2$, the cross-section $A_{max}$ could be 3.3 = 9 mm$^2$. If, starting from a certain operating situation in which the diaphragm 15 with its throttle 11 and the capsule 26 are in equilibrium, the altitude is increased and consequently atmospheric pressure decreases, for equal air flows drawn in by the engine through the duct 11 the pressure downstream of the throttle 11 falls as the throttle 11 is in the position corresponding to the previous altitude, and the pressure in the cavities 20 and 16 thus fall consequently below the equilibrium value corresponding to the new altitude. The barometic capsule 26 expands, elongating, and thrusts the needle valve in the direction to close the port 21. The pressure difference across the faces of the diaphragm 15 increases with respect to the equilibrium value, to overcome the (constant) reaction of the spring 18, and the throttle 11 is opened so that the pressure in the duct 10 downstream of the throttle 11 increases to return to the constant predetermined value, and the pressure in the cavities 20 and 16 increases to assume the equilibrium value corresponding to the particular altitude, i.e. the value for which the pressure drop across the faces of the diaphragm 15 balances the (constant) reaction of the spring 18 and for which the barometic capsule 26 assumes a new elongated configuration which gives a passage cross-section in the port 21 such as to maintain the pressure difference across the port constant.

Consequently, at zero altitude the throttle 11 assumes its position of maximum closure, as the pressure change necessary to reduce the atmospheric pressure to the desired constant value is a maximum, while at maximum operating altitude the throttle assumes its position of maximum opening as the pressure change necessary to reduce the atmospheric pressure to the same constant value is a minimum. The passage cross-section of the port 21 is a maximum at zero altitude and zero at maximum operating altitude, so that under equilibrium conditions the pressure in the cavity 16 is always less than atmospheric pressure by a constant quantity, and passes from a maximum value (at zero altitude) to a minimum value equal to the value of the pressure existing in the duct 10 downstream of the throttle 11 (at maximum operating altitude).

On varying the flow at any altitude, the pressure downstream of the throttle 11 tends to change, and with it the pressure in the cavities 20 and 16. The membrane 15 moves together with the throttle 11 about the equilibrium position corresponding to that altitude so that the pressure drop across the throttle 11 remains constant at the value corresponding to that altitude. According to its sensitivity, the barometric capsule will also undergo slight oscillation about the equilibrium configuration corresponding to the considered operating altitude, so that the pressure in the cavities 20 and 16 also remains constant at the value corresponding to the said altitude.

Because of the venturi 24 in the duct 10, the constant pressure established downstream of the throttle 11 falls at the narrow section for high air flows. In the diverging part of the venturi there is pressure recovery, because of which the pressure returns substantially to its value upstream of the venturi. As the duct 23 branches from the narrow section of the venturi, at high flows there is a lower pressure available than the constant pressure existing downstream of the throttle 11, so that the diaphragm, subjected to a slightly greater pressure difference than that corresponding to the operating altitude, causes greater opening of the throttle. Thus above certain air flow values, the air flow undergoes a smaller pressure drop through the throttle 11 and consequently the density of the air fed to the carburetor or carburetors increases proportionally, which is advantageous from the point of view of filling the engine and improves the power delivered by the engine.

Figure 2:
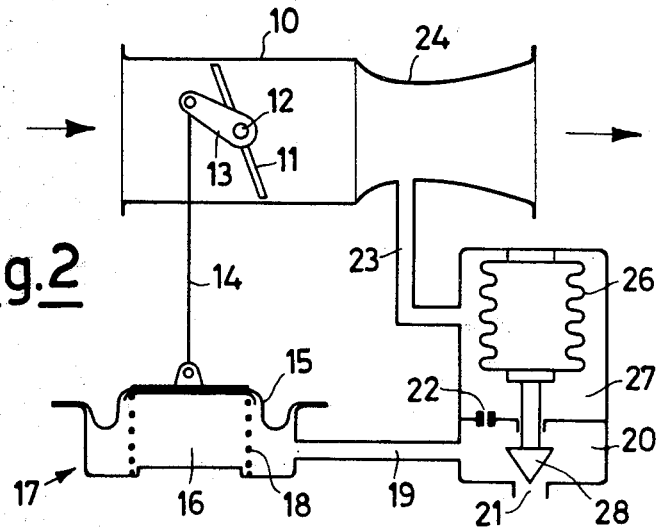

FIG. 2 shows a modification of the device illustrated in FIG. 1, and corresponding elements are indicated with the same numbers.

In this case the cavity 20 is connected through the port 22 to a further cavity 27 which is connected in its turn via the duct 23 to that region of the duct 10 downstream of the throttle 11 (and in particular to the narrow section of the venturi 24). The barometric capsule 26 is arranged in the cavity 27 and is constrained to a valve 28, the plug of which can open or close the port 21.

In this case the barometric capsule 26 is disposed in the cavity 27 which is at the same pressure as in the duct 10 downstream of the throttle 11, and thus continuously controls this pressure. The capsule assumes a predetermined partially elongated configuration so as to leave the port 21 partially open when the said pressure is at the constant predetermined value, whereas it extends so as to close the port 21 or contracts to completely open the port 21 if the pressure downstream of the throttle 11 falls or increases respectively due to variation in the operating altitude or variation in the air flow drawn in by the engine. The pressure in the cavities 16 and 20 falls to approach the value downstream of the throttle if the port 21 closes, and increases to approach the value of the external pressure if the port 21 opens completely, so that by the effect of a greater pressure difference across its faces or under the action of the spring 18 the diaphragm 15 causes the throttle 11 to assume a position such that downstream of the throttle the pressure returns to the constant predetermined value.

In this case the barometric capsule is operated by the pressure which it is required to control and not by an intermediate pressure between the external pressure and the constant pressure downstream of the throttle as in the case of the device of FIG. 1, and thus the action of the device is more rapid even in the transient states of engine operation.

Figure 3:
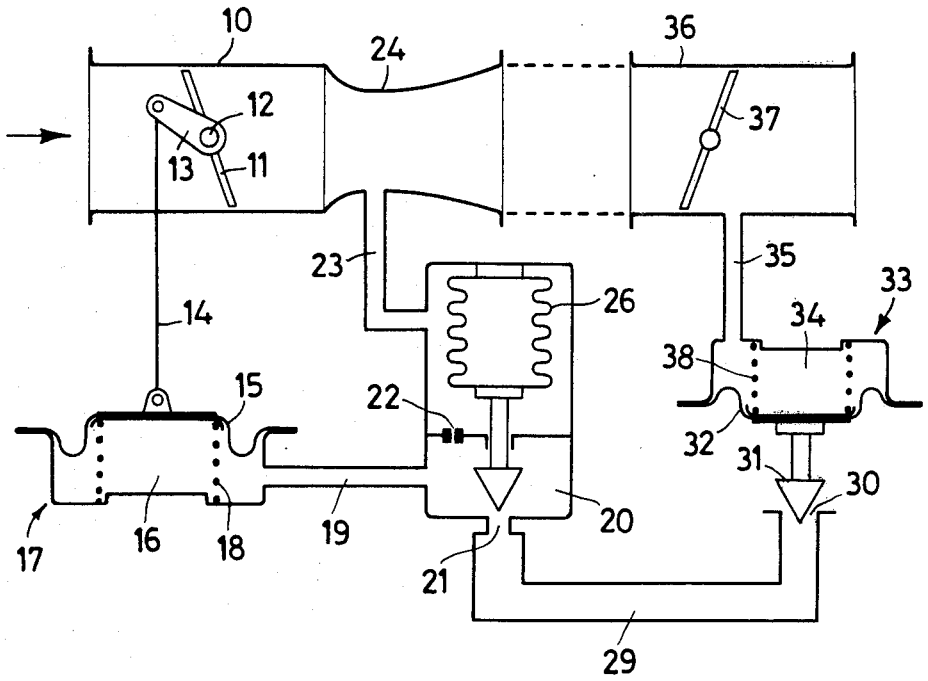

FIG. 3 shows a further modification of the device shown in FIG. 1, and again corresponding elements are indicated with the same numbers as used for FIG. 1. In this case the port 21 of variable cross-section is not freely connected to the external atmosphere but opens into the duct 29 which in its turn is connected to atmosphere through a port 30 which is also of variable cross-section. The passage cross-section of the port 30 depends on the position of the needle valve 31, constrained to the diaphragm 32. The diaphragm 32 constitutes the mobile wall of the capsule generally indicated by 33, the cavity 34 of which is connected by the duct 35 to a feed duct 36 for the engine, to which the air from the duct 10 arrives. The duct 35 opens into the duct 36 downstream of the choke 37 for the air and gasoline mixture drawn by the engine. A spring 38 is arranged in the cavity 34 to exert on the diaphragm 32 an action capable of balancing the force due to the pressure difference across its faces. Atmospheric pressure acts on the outer face of the diaphragm, and the pressure in the duct 36 downstream of the choke 37 acts on the inner face during engine operation. The diaphragm 32 thus assumes a different position according to the condition under which the engine is used. It is moved upwards at low power when the pressure downstream of the choke 37 is reduced, whereas it is moved downwards by the action of the spring 38 at high power when the pressure downstream of the choke 37 is higher. Correspondingly the port 30 is opened or closed by the needle valve 29. Thus when the engine runs at high power, the cavity 16 of the capsule 17 is connected only to the duct 10 downstream of the throttle 11, and is not connected to the outside atmosphere whatever the operating altitude. The same pressure is therefore established in the cavity 16 and in that region of the duct 10 downstream of the throttle 11, so that the pressure stabilisation effect of the device is cancelled. This means that with the device of FIG. 3 at sea level (or at low altitude) the maximum performance of the engine is not compromised. In the duct 10 the pressure is in fact only slightly less than the external pressure. The presence of the diffuser can even cancel this difference.

Figure 4:
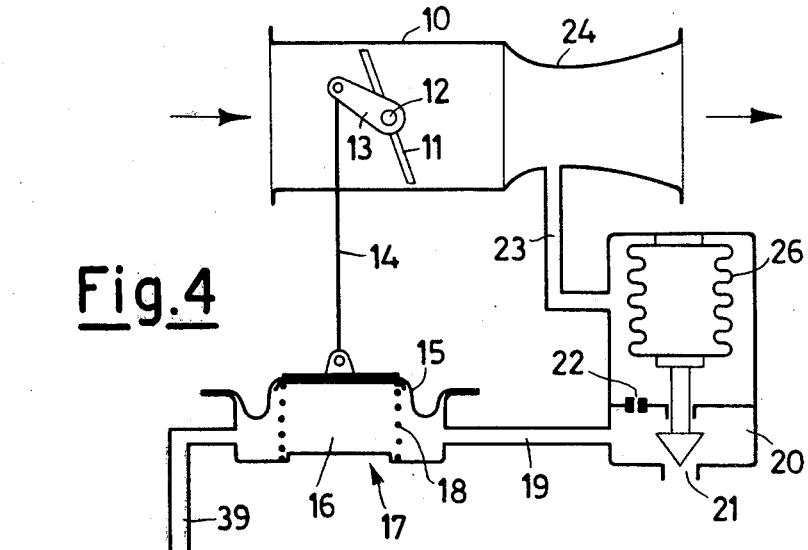

In the version of FIG. 4, the device for correcting carburetion with altitude is combined with a device for adjusting carburetion when the engine has not yet reached its full thermal running state, the object of a previous Italian patent by the same applicant Ser. No. 992,760. In this case the cavity 16 of the capsule 17 is connected to atmosphere not only via the port 21 of variable cross-section, but also by the duct 39 and a second port of variable cross-section, indicated by 40. The passage cross-section of the port 40 depends on the position of the needle valve 41 made to move axially by an element 42 sensitive to the engine operating temperature, for example to the temperature of the engine cooling liquid. With the engine cold the port 40 is at its maximum, and with the engine hot the port 40 is closed.

Thus during motor start-up, the pressure in the cavity 16 of the capsule 17 (and hence the position of the throttle 11) is a function of atmospheric pressure, of the pressure in the duct 10 downstream of the throttle 11, of the ratio between the cross-sections of the ports 21 and 22, and also of the ratio between the cross-sections of the ports 40 and 21. With the engine cold, the throttle is closed more than with the engine hot, for equal flows and equal operating altitudes, thus mixture enrichment varying automatically with the engine temperature takes place.

Figure 5:
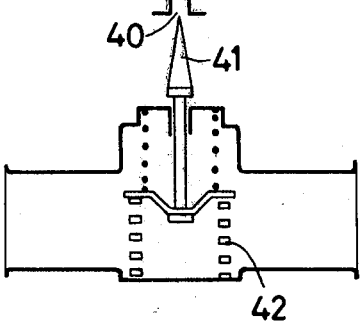
Figure 5:
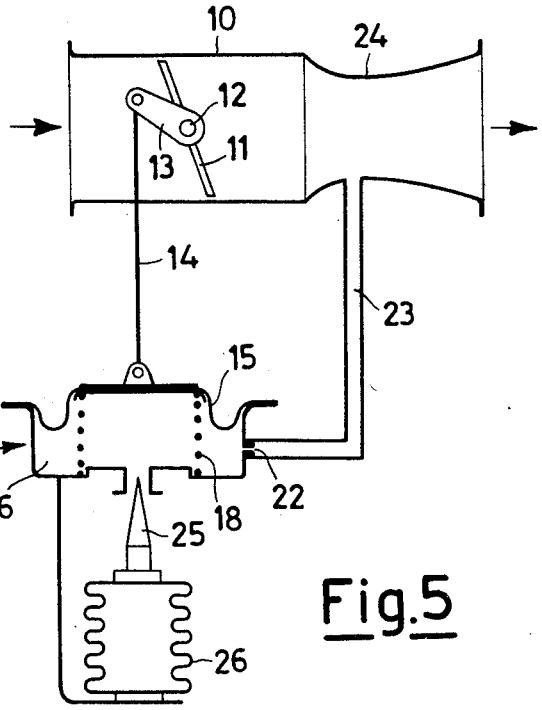

The device shown in FIG. 5 is similar and operates in the same manner as the device of FIG. 1. In this case the barometric capsule 26 is sensitive to atmospheric pressure.

What we claim is:

1. An I.C. engine particularly for motor vehicles, provided with carburetion means for forming the indrawn air and fuel mixture, provided with means for adjusting the mixture flow under different conditions of engine use and also provided with an automatic device for controlling the pressure of the air drawn in as the engine operating altitude varies, said device comprising first valve means adapted to induce in the air flow reaching the engine carburetion means a fall in pressure variable between a maximum value at zero altitude and a minimum value at a predetermined altitude so as to keep the pressure downstream of said valve means substantially constant and equal to the external pressure corresponding to said predetermined altitude independently of the altitude of operation of the engine, and also comprising first actuator means which control said first valve means and are operated by an operating pressure which, as the altitude of operation of the engine increases, assumes intermediate values between the external atmospheric pressure and the pressure existing downstream of said first valve means, at said predetermined altitude the operating pressure assuming a value equal to the substantially constant value existing downstream of said first valve means, and the device also comprising second valve means controlled by second actuator means sensitive to an absolute pressure which is a function of the external atmospheric pressure, said valve means controlled by said second actuator means modulating the operating pressure reaching said first actuator means.

2. A device as claimed in claim 1, wherein said first valve means define a first port of variable cross-section in a duct traversed by the air drawn in by the engine and disposed entirely upstream of said carburetion means, and wherein said first actuator means are constituted by a cavity defined by a mobile wall kinematically linked to said first valve means, said cavity being connected via a fixed calibrated port to that region of said duct located downstream of the first valve means, and being also connected to the external atmosphere via at least one variable port, the cross-section of which is defined by said second valve means, the external atmospheric pressure acting on one of the faces of said mobile wall and on the other face there acting said operating pressure which is intermediate between the external atmospheric pressure and the pressure downstream of said first valve means, said pressure assuming a maximum value at zero altitude, and a minimum value at said predetermined altitude equal to the substantially constant value downstream of said first valve means, elastic means being engaged with the mobile wall to exert a reaction which balances the force acting on said mobile wall by the effect of the pressure difference across its two faces, the action of these elastic means being such as to reduce the air passage port determined by the first valve means in said duct, while the action of the pressure difference is such as to increase said port.

3. A device as claimed in claim 1 wherein said second actuator means include an element deformable in accordance with the absolute pressure to which it is subjected, and on which the external atmospheric pressure acts.

4. A device as claimed in claim 1 wherein said second actuator means include an element deformable in accordance with the absolute pressure to which it is subjected, and on which acts the same pressure controlling said first actuator means and intermediate between atmospheric pressure and the pressure existing in said duct downstream of said first valve means.

5. A device as claimed in claim 2 wherein said second actuator means include an element deformable in accordance with the absolute pressure to which it is subjected, and on which acts the same pressure as acts on the inner surface of said mobile wall, said deformable element being arranged in a second cavity freely connected to the cavity defined by said wall.

6. A device as claimed in claim 2 wherein said second actuator means include an element deformable in accordance with the absolute pressure to which it is subjected, and on which acts the same pressure as exists in said duct downstream of said first valve means, said deformable element being arranged in a second cavity freely connected to said duct downstream of said first valve means.

7. A device as claimed in claim 2 wherein said cavity defined by a mobile wall is connected through said second port of variable cross-section with a further cavity which is connected in its turn to the external atmosphere through a third port of variable cross-section defined by third valve means operatively connected to third actuator means controlled by the pressure downstream of said means for adjusting the flow of mixture drawn in by the engine.

8. A device as claimed in claim 2 wherein said cavity defined by a mobile wall is connected to the external atmosphere through said second port of variable cross-section, and also through a third port of variable cross-section defined by third valve means operatively connected to third actuator means sensitive to the engine temperature.

* * * * *

UNITED STATES PATENT AND TRADEMARK OFFICE

CERTIFICATE OF CORRECTION

PATENT NO. : 4,128,086

DATED : December 5, 1978

INVENTOR(S) : Giampaolo Garcea

It is certified that error appears in the above-identified patent and that said Letters Patent are hereby corrected as shown below:

Correct column 5, line 28 as follows:

change "$\Delta p = \Delta p_A = \Delta p_B$" to ---$\Delta p = \Delta p_A + \Delta p_B$---

Signed and Sealed this

*Twenty-sixth* Day of *February 1980*

[SEAL]

*Attest:*

SIDNEY A. DIAMOND

*Attesting Officer*

*Commissioner of Patents and Trademarks*